United States Patent [19]

Glen et al.

[11] Patent Number: 4,810,996

[45] Date of Patent: Mar. 7, 1989

[54] PATIENT COMMUNICATION AND DIAGNOSTIC DEVICE

[76] Inventors: Jeffrey Glen, 1380 E. Hyde Park Blvd. Apt. 620, Chicago, Ill. 60615; Alexander Mark, 50 Park Ave., Passaic Park, N.J. 07055

[21] Appl. No.: 923,914

[22] Filed: Oct. 28, 1986

[51] Int. Cl.[4] ..... G08B 23/00

[52] U.S. Cl. ..... 340/321; 340/692; 340/573; 340/407; 340/825.19; 434/112; 379/38; 379/52

[58] Field of Search ..... 340/321, 692, 384 R, 340/384 E, 573, 286 M, 286 R, 825.19, 407; 434/112, 114, 116; 379/38, 52

[56] References Cited

U.S. PATENT DOCUMENTS

| | | | |
|---|---|---|---|
| 2,783,588 | 3/1957 | Charuat | 446/407 |
| 3,651,512 | 3/1972 | Summers | 340/286 M |
| 3,780,225 | 12/1973 | Shannon | 379/52 |
| 4,075,621 | 2/1978 | Salmon | 340/825.19 |
| 4,215,240 | 7/1980 | Ostrowski | 340/825.19 |

FOREIGN PATENT DOCUMENTS

| | | | |
|---|---|---|---|
| 0229537 | 11/1985 | Japan | 340/829.19 |
| 1604881 | 12/1981 | United Kingdom | 446/406 |

OTHER PUBLICATIONS

International Application, PCT/US85/02285, WO 86/03870, 7-1986, "Hand-Held Communication Device and System Employing Such Devices".

*Primary Examiner*—Donnie L. Crosland
*Attorney, Agent, or Firm*—Myers & Ehrlich, Ltd.

[57] ABSTRACT

A dental patient communication device to be used in instances when verbal communication is impossible or impracticable such as during dental examination and treatment; the device comprising a hollow housing, at least one and preferably three alarm buttons, and at least one audible alarm circuit capable of emitting a variety of distinct sounds and activated by the alarm buttons so that the communication of the sensation of various levels of discomfort is accomplished between the patient and the dentist. The device is designed to be either held freely in the patient's hand or gripped while mounted on an examination apparatus, such as a dental chair.

22 Claims, 2 Drawing Sheets

STOP/ BEEP/ STOP!
SOME
NO
NEIN
NON
NYET
SIN

PATIENT COMMUNICATION AND DIAGNOSTIC DEVICE

BACKGROUND OF THE INVENTION

1. Field of the Invention

This invention relates to patient communication devices, and more particularly, to communication devices designed to be used when the patient is unable to speak, such as during dental or other examination and treatment.

2. Description of the Prior Art

While in the past, the sensation of pain in the dentist's chair was considered inevitable, the recent development of safe and improved treatment procedures and apparatus have altered the nature of dental pain from its former role as a necessary evil to its modern characterization as an often avoidable process of proper dental treatment.

Patients in dental chairs most often experience pain and discomfort as teeth are being examined, cleaned, drilled or undergoing other dental work. With his mouth propped open during this treatment, and often filled with several types of dental apparatus, it is often quite impractical for the patient to accurately notify the dentist of his condition other than to make incomprehensible noises.

Thus it is difficult for the dentist to accurately gauge the condition of his patient and to take appropriate measures to relieve any pain. In many instances, the dentist must interrupt his work, and may even be forced to remove some of the treatment apparatus to determine whether or not his patient is in pain, and if so, how much. Only then can effective pain relief measures be taken.

Prior attempts to solve this problem of inefficient patient-dentist communication during treatment have involved the concept of permitting the patient to operate a "panic switch" in the power line of the dental unit. U.S. Pat. No. 2,648,043 to Grogl, et al. discloses a dental unit having a button-actuated switch adapted to be held in the patient's hand during treatment. When the power supply to the dental unit.

Likewise, British Pat. No. 727,515 to Aktiebolagnet Elema discloses an apparatus whereby a dental patient may control the rotational speed of the dental tool and the power supply to that device. Although this concept is effective in stopping the painful treatment, it encourages inefficiency by placing the ultimate control over sophisticated medical treatment in the hands of the patient, instead of the highly trained practitioner. More importantly, a safety hazard may be created by the patient's interruption of dental treatment at an inopportune moment.

Consequently there is a need for a dental patient communication device which will enable the dentist to accurately gauge the level of discomfort experienced by the patient without unduly interfering with the treatment process.

SUMMARY OF THE INVENTION

A dental or other patient communication device is provided comprising a hollow housing adapted to be hand held, either freely by the patient or mounted to the dental chair. The surface of the hollow housing contains at least one easily accessible alarm button designed to trigger an audible alarm circuit contained in the housing. The alarm circuit is capable of emitting a distinct audible signal for each of various levels of discomfort, ranging from no discomfort to unacceptable discomfort providing a feedback to the treating person where the patient cannot readily speak or verbally communicate.

The patient signals his state through the use of a large switch which is actuated by squeezing of the hand which indicates a high level of pain. More than one alarm button is used, viz, a separate alarm button may be included for each level of discomfort: no discomfort, acceptable discomfort and unacceptable discomfort. Two top mounted thumb operated switches are used to signal a lack of distress and the other to indicate a mild but acceptable level of discomfort. In that case a distinct audible signal would be activated by each alarm button. The audible signal could be a sound of any sort and could include such sounds as a bell or a language word. Furthermore, the location of the alarm buttons on the housing is such that the button for unacceptable discomfort would be most easily accessible to facilitate rapid relief, while the buttons for no discomfort or acceptable discomfort would be less accessible.

It is therefore an objective of the present invention to provide a dental or other patient communication and diagnostic device which enables the patient to indicate various levels of discomfort.

It is a further objective of the present invention to provide a dental or other patient communication device which does not abruptly interrupt dental treatment or remove the control over treatment from the hands of the dentist.

It is another objective of the present invention to provide a dental or other patient communication device which may be securely held by the patient while undergoing treatment.

It is a still further objective of the present invention to provide a dental or other patient communication device which may be operated by the patient with little instruction from the dentist.

The invention and its many attendant objects and advantages will become understood by reference to the following detailed description of the preferred embodiment when read in conjunction with the following drawings, wherein:

DESCRIPTION OF THE PREFERRED EMBODIMENT

Figures 1, 1A, 2, 2A, 3:
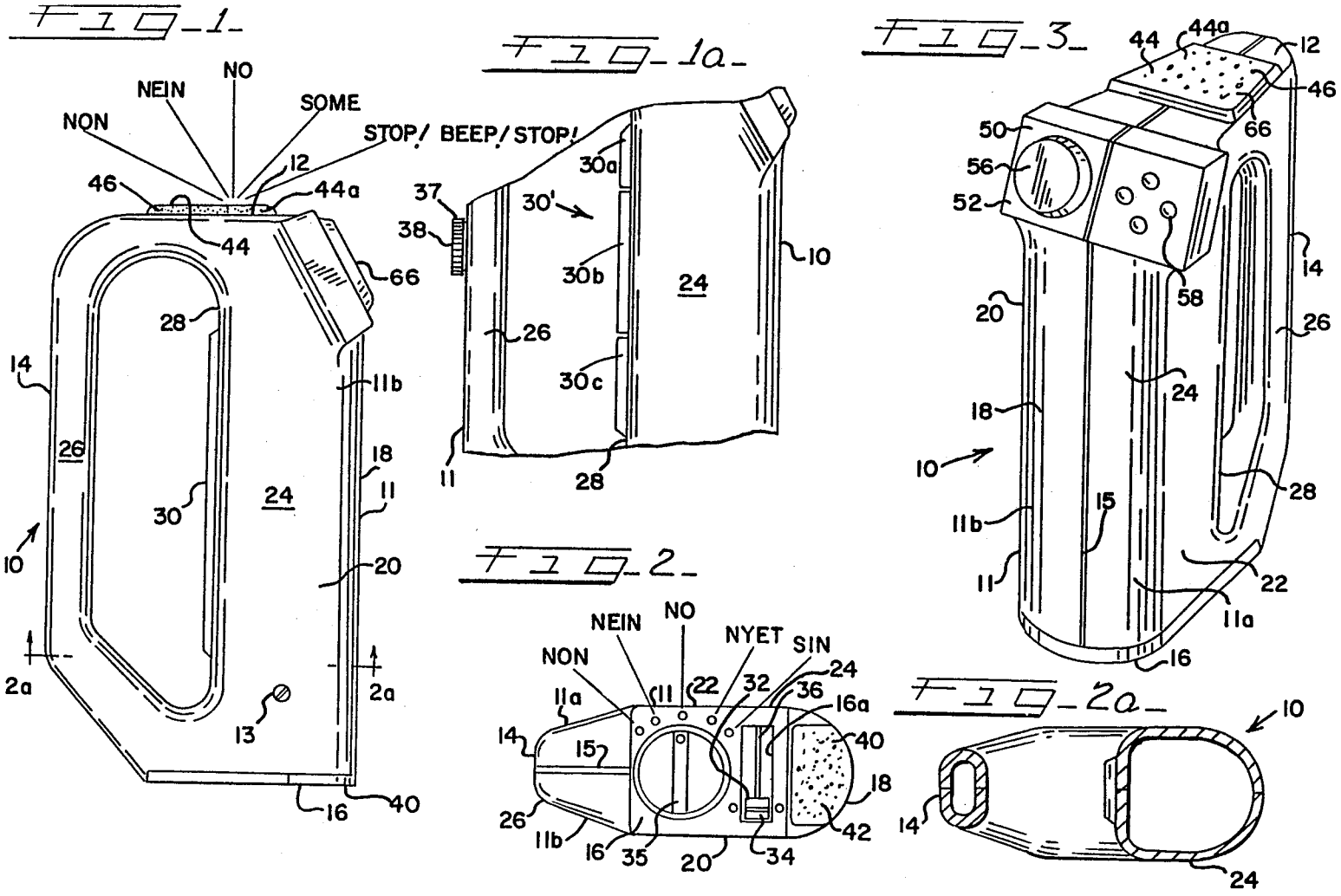
FIG. 1 is a side elevation of the dental patient communication device of the present invention.
FIG. 1*a* is a sectional view of figure showing a modified alarm button arrangement to that shown in FIG. 1.
FIG. 2 is a bottom plain view of the dental patient communication device depicted in FIG. 1.
FIG. 2*a* is a plan view illustrating the device's shaped handgrip to accommodate the user's hand.
FIG. 3 is a front elevation and top plan view in perspective of the dental patient communication device depicted in FIG. 1.
Figure 4:
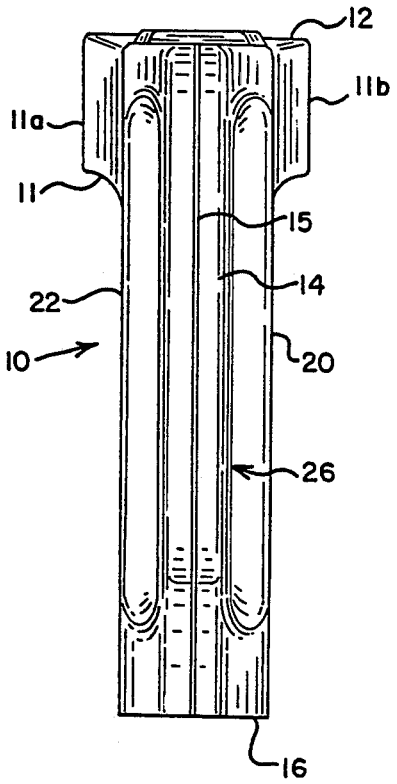
FIG. 4 is a rear elevation of the dental patient communication device depicted in FIG. 1.

Referring now to the drawings wherein like reference characters designate identical or corresponding parts, FIGS. 1–4 depict a dental patient communication device 10 comprising a housing 11 having a top 12, a rear 14, a bottom 16, a front 18 and identical sides 20 and 22. Sides 20 and 22 are comprised of a main body portion 24 designed to be comfortably held in either hand by at least 95% of the population (see FIG. 2*a*). Housing 11 may also be used in conjunction a with holster (not shown) on the dental chair which holster removably secures said device 10 to the dental chair within easy reach of the patient. Thus the patient may operate device 10 while it is in the holster.

Housing 11 is basically somewhat oval or elliptical in cross section in the preferred embodiment, but may have any cross sectional configuration or front face 28 which defines a shaped handgrip and facilitates and accommodates a secure grip by either hand of 95% of the population (see FIG. 1–3 and 2*a*). Housing 11 is preferably fabricated from a polymeric material such as high impact polystyrene, but any suitable rigid material may be used. Housing 11 is essentially comprised of at least two adjoining and preferably symmetrical mating sections 11*a* and 11*b* which are removably joined along seam 15 and are held in place by molded mounting lugs (not shown) and threaded fasteners 13.

Sides 20 and 22 further comprise a vertically oriented finger guard 26 which is integrally joined to said main body portion 24 at top 12 and bottom 16. The enclosed grip area created by finger guard 26 prevents accidental dropping of the device 10 by the patient during examination (See FIGS. 1 and 3).

The front face 28 of main body portion 24 includes vertically elongate push bar alarm button or "pain" switch 30. In the preferred embodiment (FIGS. 1 and 3), alarm button 30 is a single unit projecting slightly forward from the edge 28 of main body portion 24, and which, when pressed, indicates unacceptable discomfort to the dentist by triggering audible alarm circuit 60 (see FIG. 5). Alarm button 30 is located on the vertical axis of the front face 28 (see FIG. 2*a*) and provides ready access by the patient and yet lessen false alarm occurrence as it is protected by the finger guard 26. Since the patient's fingers are already wrapped around body portion 24 to hold the device 10, the patient need only squeeze alarm button 30 to indicate the sensation of unacceptable discomfort.

Alternatively, as seen in FIG. 1*a*, alarm button structure 30 is divided into three separate alarm buttons 30*a*, 30*b* and 30*c* of varying length, each designed to trigger a distinct alarm signal indicating a distinct level of discomfort such as no discomfort, some discomfort and severe discomfort. The relative sizes of buttons 30*a*, 30*b* and 30*c* are related to the severity of the discomfort they indicate, with larger segment 30*b* reserved for severe discomfort, and smaller buttons 30*a* and 30*c* reserved for the indication of no discomfort and acceptable discomfort respectively.

Referring now to FIG. 2, it is seen that the bottom 16 provides a convenient mounting site for power switch assembly 32, being mounted in bottom recess portion 16*a* between the language choice rotary switch 35 (different languages say "Non" or "No" or "Nein" or "Nyet" or "Sen" (Estonian))and the bottom compartment 40. Power switch assembly 32 is comprised of the on/off switch button 34 which slides along switch track 36 for volume control. Power switch assembly 32 is purposely located on the bottom 16 to provide limited accessibility to the patient, for it would be quite counterproductive of the objectives of the present invention if the patient were able to deliberately or accidentally turn device 10 on or off with little effort. To accomplish this goal of limited accessibility, switch track 36 is recessed into bottom recess 16*a* of the bottom 16 to allow switch button 34 to be mounted so that only a small portion of switch button 34 projects above the surface of bottom 16. Thus it would be difficult with the switch on the bottom for a patient to casually operate power switch button 34. Moreover the switch is often operated most effectively by the dentist's thumbnail. Thus the slide on/off switch and volume control 34 is underneath the device along with the rotary "choice of language" switch 35 (see FIGS. 2 and 5) and battery access or power terminals for charging 40. The dentist can optionally lower the volume of the distinct alarm tones in cases where the patient is overly sensitive and/or prone to incessantly operate the "unacceptable discomfort" button, usually provided with the most audibly distasteful of the distinct alarm tones. This distinct alarm tone (of the "unacceptable discomfort" button 30) would be a combination of "stop" with an alternate "warble" for redundancy. The "pain switch" is placed in relation to gripping action of hands when under duress and its signal is "stop-beep-stop" (repeats). In practice, when a troublesome patient is expected, the dentist may set the volume of the alarm circuit 60 (FIG. 5) by means of control 34 on the underside of the device before the patient arrives.

Figure 4A:
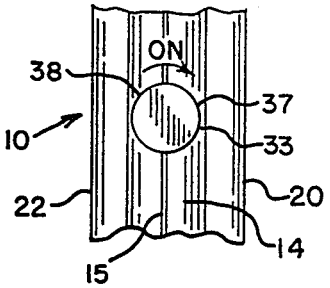
FIG. 4*a* is a partial view of the device showing a modified power switch on the device guard.

With reference now to FIGS. 1*a* and 4*a*, a modification is shown wherein finger guard 26 is provided with a power switch assembly 33 instead of having the power switch assembly in the bottom of the hand grip portion 24 of the device 10. The switch assembly 33 includes an "on and off" switch 37 and a volume control knob 38 being part of and attached to the switch 37, the assembly 33 being mounted on guard outside or the device's rear 14 to totally restrict access by the patient's gripping hand and to be out of view by a reclining patient undergoing treatment. The knob 38 is designed to be adjustable in the shape of a knurled circular knob. To operate, merely rotate assembly 33 clockwise (FIG. 4*a*) which turns on the power switch 37 and further rotation clockwise operates knob 38 to increase the volume.

The bottom 16 of housing 11 is fitted with a battery access cover 40 which slidably engages battery opening 42 at the bottom 16 of device 10 (FIG. 2). Thus, battery access door 40 slides open on a horizontal axis in an outward direction when the battery 62 (FIG. 5) inside access door 40 requires replacement.

Figure 3A:
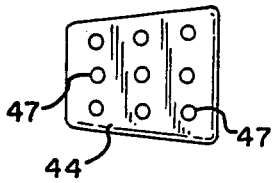
FIG. 3*a* is a plan view of an alternate speaker cover for the device depicted in FIG. 3.

The top 12 of housing 11 is fitted with a protective foam speaker cover 44 (see FIG. 3), fabricated from any sound-permeable material which provides a protective impact barrier for speaker 66 (see FIGS. 1,3,5) thereunder. Preferred materials for cover 44 include urethane foam 44*a* or a high impact polystyrene. The modified speaker cover 44*b*, shown in FIG. 3*a*, comprises a plurality of acoustical apertures 46 arranged on a flattened horizontal plate 47. The top mounting of the speaker 66 prevents obstruction thereof.

Referring now to FIG. 3, top 12 and rear 18 of housing 11 are joined at angled portion 50 which is split along its longitudinal axis by seam 15 into two symmetrical portions, 52 and 54 of sections 11*b* and 11*a*. Due to its easy accessibility by the patient's thumb, angled portion 50 is the preferred location for the alarm buttons for lack of discomfort 56 and acceptable discomfort 58. Thus the buttons 56, 58 are at a comfortable angle of about 15° with the vertical or in the approximate range of 60° to 85° with the horizontal. In the preferred embodiment, the button for acceptable discomfort 58 is located on portion 54. Any form of switching button which is easily operable with one thumb is acceptable for use as alarm buttons 56 and 58. Acceptable alternatives are toggle switches or depressable buttons.

The type of alarm button for angled portion 50 is a pressure sensitive device in which the entire surface of portions 52 and 54 is fabricated from a resilient polymer which is easily compressed. Thus the entire surface of each half of angled portion 50 does serve as a patient condition signalling button. The "lack of discomfort" or "NO" switch button 56 is a smooth texture single disc whereas the "acceptable discomfort" or "Some switch button 58 is textured with raised bumps 58' (see FIG. 3). Alarm buttons 56 and 58 also include raised English and braille symbols which properly identify each button, such as the braille symbol for "NO" for button 56 designating lack of discomfort, and the braille symbol for "SOME" for button 58 designating acceptable discomfort. The main body portion 24 is provided with the English and braille symbols for "pain" in a location adjacent to alarm button 30.

Figure 5:
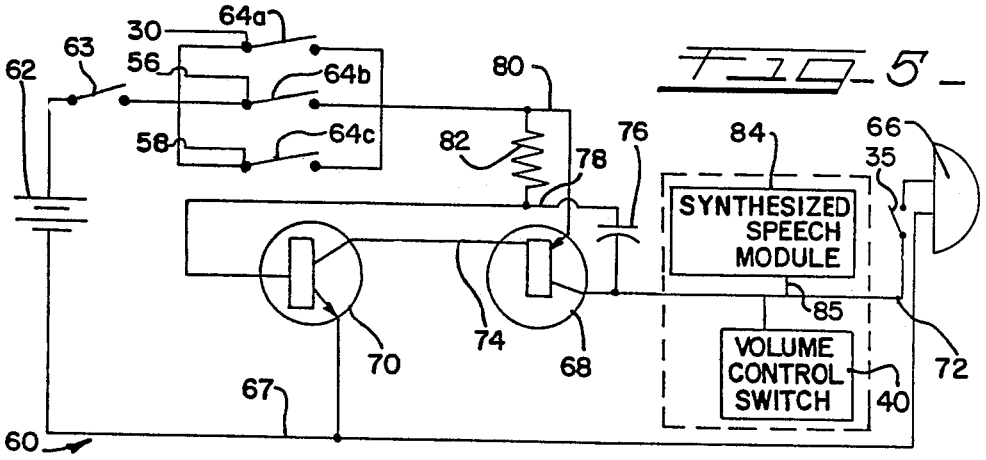
FIG. 5 is a schematic diagram of the electrical circuitry according to the invention.

Referring now to FIG. 5, the alarm circuit 60 is shown comprising a battery 62 which provides power to the circuit. The battery 62 may be a mercury battery having a generating capacity of 9 volts. The battery 62 is connected to power switch 63, which is triggered by power button 34. Power switch 63 is connected to three switches 64*a*, 64*b* and 64*c*, each of which is connected to a separate alarm button, 30, 56 and 58 respectively. The speaker 66 is connected to the battery 62 by way of ground line 67.

The speaker 66 is powered by transistors 68 and 70 and is connected to transistor 68 by a line 72 and to transistor 70 by a line 74. A capacitor 76 of approximately 0.1 microfahrads is placed in a line 78, and one end of said capacitor is connected to the transistor 70. A line 80 connects each of the switches 64*a*, 64*b* and 64*c* with the transistor 68. A resistor 82 of approximately 10K ohms is connected across line 80 and line 78.

A synthesized human speech module 84 is connected to speaker 66 on line 72 to produce appropriate condition-specific phrases (see FIGS. 2,3 and 5) such as "NO", "SOME" or "that is not comfortable", "STOP - WARBLE (ALARM) - STOP - WARBLE", etc., placed on line 72 adjacent to speaker 66. The distinct alarm signals of module 84 are produced by such companies as Texas Instruments who deal with voice synthesis microchips, etc. Language choice, on/off, and volume control switches 34, 35, 36, (see FIGS. 3,2 and 5) cooperate with speaker 66. The alarm buttons 30, 56, 58 may be in different languages (instead of just sounds) as controlled by the language choice switch 35. A final setting for a "yes/no" mode can be provided by an additional two position switch, one position for "yes" and another for "no". The separate alarm circuit 85 is provided for such alarm button switch 35 to create alarm signals which are more easily distinguishable. The speaker 66 is positioned in housing 11 near the top portion 12 in order to provide proper aural characteristics and to be unrestricted by patient's hands or by the dentist chair.

Thus the present invention discloses a dental patient condition device designed to be securely held in either of the patient's hands while undergoing dental examination. The device comprises a plurality of strategically located condition specific alarm buttons, each of which is capable of triggering a distinct alarm signal by which the dental patient can notify the dentist of the sensation of various levels of discomfort such as negligible, acceptable or unacceptable levels of discomfort. Embodiments have also been disclosed in which the device is provided with a dentist operated power and volume controls, as well as a synthesized human speech module containing appropriate condition-indicating phrases.

This device may not only be used in dental matters but may be used in medical matters such as in an emergency room, in military field injuries, in testing retarded patients or speech impaired patients. The device is applicable in any situation where verbal communication is not possible. The device may also be used for example in trauma to the face or jaw or for tracheotomy patients or for stroke victims or for the deaf and blind and in research or as a teaching tool or for patients who are handicapped such as patients with multiple sclerosis.

Although the invention has been described in its preferred form, it will be understood that various changes may be made to the present disclosure without departing from the true spirit and scope of the invention as hereinafter claimed.

What is claimed is:

1. A portable alert alarm, as for instance, in the form of a patient communication device comprising:

a housing having a main body portion and a finger guard connected to and spaced from the body portion forming a hand receiving and gripping space;

alarm tactile means on said main body projecting into said space and opposite the finger guard and operable by the fingers of the patient's hand and generating a first sound message;

said finger guard having inner surface means opposite and outwardly of the finger gripping space and said housing having opposing surface means mounting the alarm tactile means and facing and opposing the finger guard surface means in juxtaposition therewith for squeezing of the alarm tactile means by the patients inside finger portions;

further alarm tactile means on the body portion for differentiating audibly form the first mentioned alarm means for indicating a second message different from the first message;

control means for operating the alarm tactile means;

said control means having means activating said first mentioned alarm tactile means with a single grasping and squeezing action of the hand to give an immediate and direct audible signal generating said sound message;

and a portable power source mounted on said main body;

and said housing being provided with sound transmitting means cooperative with the alarm tactile means to provide a warning sound.

2. The invention according to claim 1, and an audible alarm circuit interconnecting the alarm means and the power source and the sound transmitting means.

3. The invention according to claim 1, and third alarm tactile means connecting with the other means for effecting another sensing warning sound.

4. The invention according to claim 1, and said alarm tactile means being provided with tactile indicia to inform the user whether to initiate the use of such alarm tactile means.

5. The invention according to claim 1, and said power source being located in the bottom of the main body and accessible.

6. A portable alert alarm, as for instance, in the form of a dental patient communication device comprising;

a housing having a main body portion;

a finger guard connected to and spaced from the body portion and forming a hand gripping receiving space;

alarm button means on said main body claspible by the fingers of person's hand and recording a first sound message;

said finger guard having inner surface means opposite and outwardly of the finger gripping space and said housing having opposing surface means mounting the alarm button means and facing and opposing the finger guard surface means in juxtaposition therewith for squeezing of the alarm button means by the patients inside finger portions;

control means for operating the alarm button means;

said control means having means for actuating by said alarm button means with a single grasping and squeezing action of the hand to give an immediate and direct audible signal generating said sound message;

and said housing being provided with the alarm button means to provide a warning sound.

7. The invention according to claim 6, and a further alarm button means being angled and tapered to provide dexterity for the user's finger.

8. The invention according to claim 6, and the control means being located in the bottom of the main body out of reach of the user's hand.

9. The invention according to claim 6, and the control means being located on the guard out of reach of the user's hand.

10. The invention according to claim 6, and said main body being provided with means for annunciating language.

11. The invention according to claim 6, and the alarm button means being three buttons mounted adjacent one another in said space.

12. The invention according to claim 6, and said housing providing hand grip means being shaped to provide easy grasp by the user's hand.

13. The invention according to claim 6, and said alarm button means being at approximately 65°-85° with the horizontal.

14. A dental patient communication device comprising;

a hollow housing;

alarm means comprised of at least one alarm button means mounted to said housing;

finger guard means having inner surface means opposite and outwardly of a finger gripping space and said housing having opposing surface means mounting the alarm button means and facing and opposing the finger guard surface means in juxtaposition therewith for squeezing of the alarm button means by the patient s inside finger portions;

at least one alarm circuit contained in said housing and activated by said alarm button means;

means activating said alarm button means with a single grasping and squeezing action of the hand to give an immediate and direct audible signal generating a sound message;

said alarm button means and alarm circuit enable the communication of the sensation of various levels of discomfort experienced by said patient.

15. The invention according to claim 14, and wherein said alarm means comprises alarm buttons which indicate unacceptable discomfort, acceptable discomfort and lack of discomfort.

16. The invention according to claim 14, and wherein said alarm means comprises three separate alarm buttons, one each for indicating unacceptable discomfort, acceptable discomfort and lack of discomfort.

17. The invention according to claim 14, and wherein said alarm button means and said alarm circuit comprise an audible alarm signal.

18. The invention according to claim 14 and wherein each of said alarm circuits is associated with a distinct alarm audible.

19. The invention according to claim 14, and comprising additional alarm circuits, wherein each of said alarm circuits is associated with a distinct audible alarm such that there is one audible alarm signal for unacceptable pain, one audible alarm signal for acceptable pain and one audible alarm signal for the lack of pain.

20. The invention according to claim 19, and wherein said audible alarms are distinct phrases of synthesized human speech.

21. The invention according to claim 14, and wherein each of said alarm circuits is comprised of a battery having a ground line and a power line, a switch engaged by one of said alarm buttons and connected in series to said power line of said battery, a speaking means connected to said battery by said ground and powered by and connected to a transistor, said transistor connected to a capacitor and a resistor connected to said switch.

22. The invention according to claim 16, and wherein an alarm circuit is provided for each of said alarm buttons.

* * * * *